US006140297A

United States Patent [19]

Ishii et al.

[11] Patent Number: 6,140,297

[45] **Date of Patent: *Oct. 31, 2000**

[54] ETHOXYLATE AND PROPOXYLATED HIGHER ALCOHOL SURFACTANT IN HIGH CONCENTRATIONS IN AN AQUEOUS COMPOSITION

[75] Inventors: Yasuo Ishii; Atsuhito Mori; Hiroki Sawada, all of Wakayama, Japan

[73] Assignee: Kao Corporation, Tokyo, Japan

[ * ] Notice: This patent is subject to a terminal disclaimer.

[21] Appl. No.: 09/117,182

[22] PCT Filed: Dec. 2, 1997

[86] PCT No.: PCT/JP97/04394

§ 371 Date: Jul. 29, 1998

§ 102(e) Date: Jul. 29, 1998

[87] PCT Pub. No.: WO98/24867

PCT Pub. Date: Jun. 11, 1998

[30] Foreign Application Priority Data

Dec. 2, 1996 [JP] Japan ..... 8-321272

[51] Int. Cl.[7] ..... C11D 1/722; C11D 1/72

[52] U.S. Cl. ..... 510/360; 510/421; 510/506; 510/636; 510/535; 568/625

[58] Field of Search ..... 510/421, 506, 510/535, 360; 568/625

[56] References Cited

U.S. PATENT DOCUMENTS

| | | | |
|---|---|---|---|
| 3,504,041 | 3/1970 | Weipert et al. | 568/625 |
| 3,567,784 | 3/1971 | Tsatsos et al. . | |
| 3,752,857 | 8/1973 | Milligan | 568/625 |
| 4,115,457 | 9/1978 | Wiedemann | 568/625 |
| 4,134,854 | 1/1979 | Milligan . | |
| 4,624,803 | 11/1986 | Balzer et al. | 510/219 |
| 4,745,230 | 5/1988 | Otten et al. | 568/621 |

FOREIGN PATENT DOCUMENTS

| | | |
|---|---|---|
| 47-9561 | 5/1972 | Japan . |
| 53-113805 | 10/1978 | Japan . |
| 1371770 | 10/1974 | United Kingdom . |
| 1601652 | 11/1981 | United Kingdom . |

OTHER PUBLICATIONS

Suffactants & Detergents, Journal of the American Oil Chemist's Society, JAOCS, vol. 63, No. 9 (Sep. 1986).

Nonionic Surfactants, Physical Chemistry, Martin J. Schick, 1987, Surfactant Science Series.

*Primary Examiner*—Necholus Ogden
*Assistant Examiner*—Christine Ingersoll
*Attorney, Agent, or Firm*—Oblon, Spivak, McClelland, Maier & Neustadt, P.C.

[57] ABSTRACT

A surfactant composition exhibiting excellent wetting properties and a high penetrating power for the object to be cleansed even in a relatively high surfactant content and being excellent in detergency is provided, which comprises a compound (1) having an average molecular weight of 1,200 or less and water with the proportion of the compound (1) to the sum total of the compound (1) and water being 5 wt. % or above but below 50 wt. %:

$$RO—(EO)_x—(PO)_y—(EO)_{x'}—H \quad (1)$$

wherein R represents $C_{12}$–$C_{15}$ alkyl or the like; EO represents oxyethylene; PO represents oxypropylene; x and x' are each 1 or above; and y ranges from 0.5 to 6.0, provided $(EO)_x$, $(PO)_y$ and $(EO)_{x'}$ are bonded to each other in block in this order.

5 Claims, No Drawings

ETHOXYLATE AND PROPOXYLATED HIGHER ALCOHOL SURFACTANT IN HIGH CONCENTRATIONS IN AN AQUEOUS COMPOSITION

TECHNICAL FIELD

The present invention relates to a surfactant composition, more specifically a surfactant composition useful as household and industrial detergents which comprises a specific nonionic surfactant and which exhibits a high penetrating power, and is excellent in detergency.

BACKGROUND ART

Polyoxyethylene-base nonionic compounds have been known for long to be useful as surfactant and detergent, and the physical properties and synthesis methods of them and the emulsifying, solubilizing and cleansing characteristics thereof have been studied and reported in fair detail (see Martin J. Schick, NONIONIC SURFACTANTS PHYSICAL CHEMISTRY (1987) and so on).

Such polyoxyethylene-base nonionic surfactants have high detergency and can also be used favorably in a state combined with other ionic surfactant, so that various combinations thereof with other surfactants have been proposed.

With respect to household and industrial detergents, meanwhile, a formulation having a higher surfactant concentration has recently been required from the standpoints of energy saving in the production or transportation, resource nursing, and diminution in the containers to be disposed of. However, new problems occur with an increase in the surfactant concentration of the detergent. Specifically, a surfactant composition containing a surfactant in a higher concentration fails in removing stains completely owing to its poor penetrating power, when the composition is applied or sprayed directly on stains or the object to be cleansed is immersed in the composition, followed by washing or rinsing in large amount of water.

U.S. Pat. No. 4,134,854 discloses a specific polyalkylene oxide adduct as a low-melting nonionic surfactant. However, this US Patent Specification is silent on the favorable concentration of the surfactant composition containing this adduct or on the penetrating power of the high-concentration surfactant composition containing the adduct.

U.S. Pat. No. 3,567,784 discloses that another specific polyalkylene oxide adduct has a high cloud point and a low gelation temperature. However, this US Patent Specification is silent on the high-concentration surfactant composition containing this adduct.

Furthermore, JP-A 47-9561 (corresponding to U.S. Pat. No. 4,115,457) discloses a process for the preparation of another specific polyalkylene oxide adduct which is useful as a scouring agent or dyeing aid. However, it is silent on high-concentration surfactant compositions exhibiting high penetrating power.

Further, JAOCS, Vol. 63, No. 9, pp. 1201–1208 (1986) discloses the physical properties of similar polyalkylene oxide adducts.

DISCLOSURE OF INVENTION

An object of the present invention is to provide a surfactant composition which exhibits high wetting properties and a high penetrating power for the object to be cleansed even when it contains a surfactant in a relatively high concentration and which exhibits high detergency even when used at an ordinarily low surfactant concentration (0.01 to 1.0 wt. %).

The inventors of the present invention have found that the above object can be attained by a surfactant composition containing a polyoxyalkylene-base nonionic surfactant specified in the mode of addition in a specific amount. The present invention has been accomplished on the basis of this finding.

The present invention relates to a surfactant composition comprising a compound represented by the following general formula (1) and having an average molecular weight of 1,200 or less and water, with the proportion of the compound represented by the general formula (1) to the sum total of the compound and water being 5 wt. % or above but below 50 wt. %:

$$RO—(EO)_x—(PO)_y—(EO)_{x'}—H \quad (1)$$

wherein R represents $C_{12}$–$C_{15}$ linear or branched alkyl or alkenyl; EO represents oxyethylene; PO represents oxypropylene; x and x' represent each a mean number of moles of the ethylene oxide added and are each 1 or above; and y represents a mean number of moles of the propylene oxide added and ranges from 0.5 to 6.0, provided $(EO)_x$, $(PO)_y$ and $(EO)_{x'}$ are bonded to each other in block in this order.

The mode for carrying out the present invention will now be described in detail.

The compound of the general formula (1) having an average molecular weight of 1,200 or less to be used in the present invention can be prepared by reacting an alcohol represented by the general formula (2):

$$R—OH \quad (2)$$

(wherein R is as defined above)
with ethylene oxide, with propylene oxide, and then with ethylene oxide to conduct block addition.

The alcohol represented by the above general formula (2) includes $C_{12}$–$C_{15}$ saturated and unsaturated, primary and secondary, linear and branched alcohols. It is preferable that R have 12 to 14 carbon atoms. In particular, a compound represented by the general formula (1) wherein R is linear alkyl or alkenyl is desirable because of its high detergency. Specific examples thereof include linear alcohols such as lauryl alcohol and myristyl alcohol [e.g., "Kalcohl 2098" and "Kalcohl 4098 (trade names), products of Kao Corporation]; mixed $C_{12}$–$C_{15}$ alcohols [e.g., "Kalcohl 2474" (trade name), a product of Kao Corporation]; branched $C_{12}$–$C_{15}$ alcohols prepared by the oxo method or Ziegler method [such as "Oxocol 1213" and "Tridecanol" (trade names), products of Kyowa Hakko Kogyo Co., Ltd.; "Dobanol 23" and "Dobanol 25" (trade names), products of Mitsubishi Chemical Corp.; and "Neodol 23" and "Neodol 25" (trade names), products of Shell Chemical]; and so on. Among these alcohols, those mainly comprising $C_{12}$–$C_{14}$ alcohols are particularly preferable.

The addition reaction of the above alcohol with the alkylene oxides may be conducted by any known alkoxylation method in the presence of a catalyst. The order of addition of the alkylene oxides is essential to the present invention, i.e., the addition reaction with ethylene oxide must be first conducted, following by that with propylene oxide and that with ethylene oxide successively by block addition. The catalyst to be used in this alkoxylation may be any of acid catalysts and base catalysts. Further, the catalyst may be one disclosed in JP-A 7-227540 which can give a narrow range of distribution of addition of alkylene oxide, for example, MgO—ZnO, MgO—SnO, MgO—$TiO_2$ or MgO—SbO, or a Mg catalyst disclosed. in JP-A 1-164437 which can selectively give a narrow range of distribution of addition of alkylene oxide.

In the compound represented by the general formula (1), the mean numbers of moles of the ethylene oxide added, i.e., x and x' are each 1 or above. It is preferable from the standpoint of the compatibility of the compound with water that the sum of x and x' be 4 or above, while it is preferable from the standpoint of the penetrating power thereof that the sum be up to 20. The sum ranges particularly preferably from 6 to 15.

On the other hand, the mean number of moles of the propylene oxide added, i.e., y ranges from 0.5 to 6.0, preferably from 1 to 4.5. When y is less than 0.5, the resulting composition will be poor in penetrating power, while when it exceeds 6, the composition will be poor in detergency.

The average molecular weight of the compound represented by the general formula (1) is 1,200 or less, preferably 1,000 or less. When the average molecular weight exceeds 1,200, the resulting compound will be poor in detergency and penetrating power.

In the surfactant composition of the present invention, the proportion of the compound represented by the general formula (1) to the sum total of the compound and water is 5 wt. % or above but below 50 wt. %, particularly preferably 15 to 40 wt. %. When the proportion is less than 5 wt. %, the production and transportation of the composition will be costly uneconomically, while when it exceeds 50 wt. %, the resulting composition will be poor in penetrating power.

The surfactant composition of the present invention may further contain other nonionic surfactants, anionic surfactants, cationic surfactants, amphoteric surfactants, chelating agents, fungicides and so on, as far as the effects of the present invention are not impaired thereby. Further, viscosity modifiers such as viscosity improver builder and viscosity depressant may be added to the surfactant composition in order to regulate the characteristics of the compositions.

It is effective in improving the penetrating power of the surfactant composition of the present invention to add a water-compatible solvent to the composition as a viscosity depressant. Examples of such a water-compatible solvent include lower alcohols such as ethanol, isopropanol and butanol; glycol ethers such as ethylene glycol monoethyl ether, ethylene glycol monobutyl ether, diethylene glycol monoethyl ether, diethylene glycol monobutyl ether, diethylene glycol monohexyl ether, diethylene glycol monophenyl ether and ethylene glycol monobenzyl ether; and diols such as ethylene glycol, propylene glycol and 1,3-butanediol. The use of a large amount of the solvent is liable to cause ignition, so that the amount of the solvent to be added is preferably 0.1 to 10 wt. %, still preferably 0.1 to 5 wt. %.

Examples of the nonionic surfactant to be optionally added to the surfactant composition of the present invention include fatty acid diethanolamides, amine oxides, and polyalkylnene glycol alkyl ethers other than those represented by the above general formula (1). Examples of the anionic surfactant to be added thereto include alkanesulfonic acid salts, alkylbenzene-sulfonic acid salts, α-olefinsulfonic acid salts, alkylsulfuric acid salts, alkyl ether sulfuric acid salts, α-sulfofatty acid salts and higher fatty acid salts. Those of the cationic surfactant to be added thereto include aliphatic amine salts and quaternary ammonium salts; and those of the amphoteric surfactants to be added thereto include betaines, sulfobetaines and amino acid salts. Those of the chelating agent include sodium ethylenediaminetetraacetate and sodium nitrilo-triacetate; and those of the fungicide include benzalkonium chloride and so on.

The surfactant composition of the present invention exhibits high wetting properties and a high penetrating power for the object to be cleansed even when it contains a surfactant in a relatively high concentration, and has high detergency. Therefore, the composition is effective particularly in removing the stains soaking into the inside of the object or those existing on the uneven surface, being useful for liquid detergents. Thus, the surfactant composition of the present invention is not only favorably usable as a detergent for tableware, house, bathroom and clothes, but also industrially useful as a detergent for fibers, metals and electronic components, a dispersant for organic or inorganic powders which need wettability and penetrability, or solubilizing agent.

The present invention will now be described in more detail by referring to the following Synthesis Examples relating to the preparation of nonionic surfactants and the following Examples relating to the surfactant compositions of the present invention, though the present invention is not limited by them.

The average molecular weight of each nonionic surfactant was determined by the following method.

That is, the hydroxyl number of each nonionic surfactant was determined by neutralization titration according to JIS K 0070, and the average molecular weight thereof was calculated from the hydroxyl number thus determined according to the following formula:

$$\text{av. mol. wt.} = \frac{56108}{\text{hydroxyl no.}}$$

SYNTHESIS EXAMPLE 1

Synthesis of compound represented by the formula:

$$C_{12}H_{25}O—(EO)_5—(PO)_4—(EO)_5—H$$

Five hundred grams of lauryl alcohol ("Kalcohl 2098" (trade name), a product of Kao Corporation) and 3.0 g of potassium hydroxide were charged into a 5-1 rotary agitated autoclave equipped with two metering tanks for ethylene oxide and propylene oxide, followed by purging with nitrogen. The contents were heated to 110° C. and dehydrated in a vacuum of 40 Torr for one hour. The resulting contents were heated to 150° C. and 592 g of ethylene oxide was introduced into the autoclave by pressurizing to 3.5 kg/cm$^2$. The resulting contents were reacted until the pressure lowered to become constant. Then, the resulting contents were cooled to 120° C., and 624 g of propylene oxide was introduced into the autoclave by pressurizing to 3.5 kg/cm$^2$. The resulting contents were reacted until the pressure lowered to become constant in the same way as ethylene oxide. Thereafter, the resulting contents were heated again to 150° C., and 592 g of ethylene oxide was introduced thereinto. The resulting mixture were reacted until the pressure lowered to become constant. After the completion of the reaction, the temperature of the contents was lowered, followed by sampling. About 2.3 kg of the objective polyalkylene glycol lauryl ether was obtained (av. mol. wt.: 858).

SYNTHESIS EXAMPLES 2 to 14

The nonionic surfactants listed in Table 1 were prepared in a similar manner to that of Synthesis Example 1.

TABLE 1

| Synth. Ex. No. | Nonionic surfactant structural formula | av. mol. wt. | Remarks |
|---|---|---|---|
| Synth. Ex. 2 | n-$C_{12}H_{25}O$—$(EO)_3$—$(PO)_{1.5}$—$(EO)_3H$ | 537 | invention |
| Synth. Ex. 3 | n-$C_{12}H_{25}O$—$(EO)_3$—$(PO)_4$—$(EO)_3H$ | 682 | |
| Synth. Ex. 4 | n-$C_{12}H_{25}O$—$(EO)_5$—$(PO)_2$—$(EO)_5H$ | 742 | |
| Synth. Ex. 5 | n-$C_{12}H_{25}O$—$(EO)_7$—$(PO)_2$—$(EO)_5H$ | 830 | |
| Synth. Ex. 6 | n-$C_{12}H_{25}O$—$(EO)_7$—$(PO)_3$—$(EO)_3H$ | 800 | |
| Synth. Ex. 7 | n-$C_{12}H_{25}O$—$(EO)_7$—$(PO)_4$—$(EO)_7H$ | 1034 | |
| Synth. Ex. 8 | n-$C_{12}H_{25}O$—$(EO)_5$—$(PO)_4$—$(EO)_5H$ | 858 | |
| Synth. Ex. 9 | *n-$C_{12-13}$-oxo-$(EO)_5$—$(PO)_4$—$(EO)_5H$ | 870 | |
| Synth. Ex. 10 | n-$C_{14}H_{29}O$—$(EO)_5$—$(PO)_2$—$(EO)_5H$ | 770 | |
| Synth. Ex. 11 | n-$C_{12}H_{25}O$—$(EO)_{10}$—$(PO)_4$—H | 858 | comp. |
| Synth. Ex. 12 | n-$C_{12}H_{25}O$—$(PO)_4$—$(EO)_6H$ | 682 | |
| Synth. Ex. 13 | n-$C_{12}H_{25}O$—$(EO)_{10}$—$(PO)_4$—$(EO)_{10}H$ | 1298 | |
| Synth. Ex. 14 | n-$C_{12}H_{25}O$—$(EO)_5$—$(PO)_7$—$(EO)_5H$ | 1032 | |

Note)
*: C12–C13 oxo alcohol ("Dobanol 23" (trade name), a product of Mitsubishi Chemical Corp.,
hydroxyl number: 283) was used as the starting alcohol.

EXAMPLES 1 TO 13 AND COMPARATIVE EXAMPLES 1 TO 9

Surfactant compositions were prepared according to the formulae specified in Table 2 and examined for penetration time and rate of degreasing by the following methods. The results are given in Table 2.

<Penetration time>

A piece (2 cm×2 cm) of an unscoured and desized gray fabric was made to float on each surfactant composition to determine the time which has elapsed until the settlement of the piece. This determination was repeated at 25° C. five times and the average of the five results was taken as the penetration time.

The composition exhibiting a penetration time of 30 seconds or below is judged excellent in penetrating power, and that exhibiting a permeation time of 10 seconds or below is particularly excellent therein.

<Rate of degreasing>

(i) Preparation of Artificially Stained Cloth for the Evaluation of Degreasing Power Two hundred grams of triolein was dissolved in 80 l of Perclene, and a #2003 shirting cloth was immersed in the solution prepared above to make the triolein adhere to the cloth. The resulting cloth was dried to remove the Perclene. Thus, an artificially stained cloth was prepared.

(ii) Evaluation Method for Degreasing Power

The above artificially stained cloth was cut into pieces (5 cm×5 cm). Each surfactant composition was applied on five of the pieces in a two centimeter square in an amount of 0.1 g per piece in terms of active ingredient. Five pieces thus treated were washed together in a Terg-O-Tometer at 100 rpm under the following conditions.

*Washing Conditions:

washing time: 10 min hardness of water: 4° DH rinsing: in tap water for 5 min

After the washing, a piece of 2 cm×2 cm was cut accurately from part coated with the surfactant composition of the above artificially stained piece of 5 cm×5 cm. A set of 5 pieces (2 cm×2 cm) were subjected together to Soxhlet extraction with chloroform for 12 hours. Separately, pieces (5 cm×5 cm) of unwashed stained cloth were cut out to a two centimeter square and subjected to the same extraction as above.

The extracts were each freed from the chloroform by the use of an evaporator to determine the quantity of extracted triolein. The rate of degreasing was calculated by the following formula:

$$\text{rate of degreasing (\%)} = \frac{\text{quantity of triolein extracted from unwashed stained cloth} - \text{quantity of triolein extracted from washed stained cloth}}{\text{quantity of triolein extracted from unwashed stained cloth}} \times 100$$

TABLE 2

| | Formula of surfactant compn. nonionic surfactant RO—$(EO)_x$—$(PO)_y$—$(EO)_{x'}$—H R | x | y | x' | content (%) | water content (%) | Penetration time (s) | Rate of degreasing (%) |
|---|---|---|---|---|---|---|---|---|
| Ex. 1 | n-$C_{12}H_{25}$ | 3 | 1.5 | 3 | 30 | 70 | 7.1 | 65 |
| 2 | " | | | | 15 | 85 | 2.0 | 63 |
| 3 | n-$C_{12}H_{25}$ | 3 | 4 | 3 | 30 | 70 | 4.0 | 65 |
| 4 | " | | | | 40 | 60 | 19.0 | 66 |
| 5 | n-$C_{12}H_{25}$ | 5 | 2 | 5 | 30 | 70 | 6.3 | 70 |
| 6 | n-$C_{12}H_{25}$ | 2 | 7 | 5 | 30 | 70 | 18.0 | 72 |
| 7 | n-$C_{12}H_{25}$ | 7 | 3 | 3 | 30 | 70 | 5.0 | 74 |
| 8 | n-$C_{12}H_{25}$ | 7 | 4 | 7 | 30 | 70 | 18.9 | 70 |

TABLE 2-continued

| | | Formula of surfactant compn. | | | | | | |
|---|---|---|---|---|---|---|---|---|
| | | nonionic surfactant RO—(EO)$_x$—(PO)$_y$—(EO)$_{x'}$—H | | | | content | water content | Penetration | Rate of degreasing |
| | | R | x | y | x' | (%) | (%) | time (s) | (%) |
| | 9 | n-$C_{12}H_{25}$ | 5 | 4 | 5 | 30 | 70 | 3.7 | 75 |
| | 10 | " | | | | 40 | 60 | 17.6 | 72 |
| | 11 | " | | | | 15 | 85 | 1.5 | 75 |
| | 12 | $C_{12-13}$ oxo | 5 | 4 | 5 | 30 | 70 | 3.8 | 75 |
| | 13 | n-$C_{14}H_{21}$ | 5 | 2 | 5 | 30 | 70 | 22.5 | 73 |
| Comp. | 1 | n-$C_{12}H_{25}$ | 6 | 0 | 0 | 30 | 70 | 100< | 42 |
| Ex. | 2 | n-$C_{12}H_{25}$ | 12 | 0 | 0 | 30 | 70 | 100< | 45 |
| | 3 | 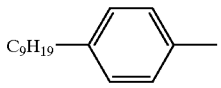 | 9 | 0 | 0 | 30 | 70 | 100< | 41 |
| | 4 | " | | | | 15 | 85 | 37 | 51 |
| | 5 | n-$C_{12}H_{25}$ | 10 | 4 | 0 | 30 | 70 | 7.1 | 49 |
| | 6 | n-$C_{12}H_{25}$ | 0 | 4 | 6 | 30 | 70 | 100< | 43 |
| | 7 | n-$C_{12}H_{25}$ | 10 | 4 | 10 | 30 | 70 | 100< | 40 |
| | 8 | n-$C_{12}H_{25}$ | 5 | 7 | 7 | 30 | 70 | 11 | 42 |
| | 9 | n-$C_{12}H_{25}$ | 5 | 4 | 5 | 55 | 45 | 100< | 41 |

As apparent from the results given in Table 2, the surfactant compositions of the present invention can be used even in a concentration higher than that employed conventionally, i.e. in a concentration of 30% or above, and are excellent in penetrating power and detergency, thus being effective in removing the stains soaking into the fine pores of the artificially stained cloth. Therefore, the surfactant composition is useful as the detergent for clothes, particularly for the pre-wash of them. On the other hand, the compositions containing nonionic surfactants outside the scope of the present invention (Comparative Examples 1 to 8) exhibit low rates of degreasing, because they are poor in penetrating power or because they are poor in detergency though excellent in penetrating power. Further, the surfactant composition containing a surfactant concentration lying outside the range of the present invention (Comparative Example 9) is poor in penetrating power to result in a low rate of degreasing.

EXAMPLES 14 TO 16 AND COMPARATIVE EXAMPLES 10 AND 11

Surfactant compositions containing water-soluble solvents were prepared according to the formulae specified in Table 3 and examined for penetration time and rate of degreasing in the same manner as that of Example 1. The results are given in Table 3.

TABLE 3

| | | Formula of surfactant compn. | | | | | | | | |
|---|---|---|---|---|---|---|---|---|---|---|
| | | nonionic surfactant RO—(EO)$_x$—(PO)$_y$—(EO)$_{x'}$—H | | | | content | solvent | | water content | Penetration | Rate of degreasing |
| | | R | x | y | x' | (%) | kind | content (%) | (%) | time (s) | (%) |
| Ex. | 14 | n-$C_{12}H_{25}$ | 5 | 4 | 5 | 40 | ethanol | 5 | 55 | 10.1 | 74 |
| | 15 | n-$C_{12}H_{25}$ | 5 | 4 | 5 | 45 | propylene glycol | 5 | 50 | 20.4 | 73 |
| | 16 | n-$C_{12}H_{25}$ | 7 | 2 | 5 | 30 | ethanol | 3 | 67 | 15.7 | 74 |
| Comp. Ex. | 10 | 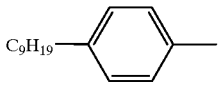 | 9 | 0 | 0 | 30 | propylene glycol | 5 | 65 | 75.6 | 44 |
| | 11 | n-$C_{12}H_{25}$ | 12 | 0 | 0 | 30 | ethanol | 5 | 55 | 100< | 46 |

As apparent from the results given in Table 3, the surfactant compositions of the present invention exhibited excellent penetrating power and detergency. On the other hand, the compositions containing nonionic surfactants outside the scope of the present invention (Comparative Examples 10 and 11) were unsatisfactory in penetrating power and rate of degreasing, though they contained solvents.

The surfactant composition of the present invention exhibits high wetting properties and a high penetrating power for the object to be cleansed even when it contains a surfactant in a relatively high concentration, and has high detergency. Therefore, the composition is effective particularly in removing the stains soaking into the inside of the object or those existing on the uneven surface. Thus, the surfactant composition of the present invention is not only favorably usable as the detergent for tableware, house, bathroom and clothes, but also industrially useful as the detergents for fibers, metals and electronic components, the dispersant for organic or inorganic powders which need wettability and penetrability, or as the solubilizing agent.

We claim:

1. A surfactant composition comprising:

(a) a compound having an average molecular weight of 1,200 or less represented by the formula (I)

$$RO—(EO)_x—(PO)_y—(EO)_{x'}—H \quad (I)$$

wherein

R represents $C_{12}$–$C_{15}$ linear or branched alkyl or alkenyl;

EO represents oxyethylene;

PO represents oxypropylene;

x and x' represent each a mean number of moles of the ethylene oxide added and are each 1 or above, wherein the sum of x and x' ranges from 4 to 20;

y represents a mean number of moles of the propylene oxide added and ranges from 1 to 4.0, wherein $(EO)_x$, $(PO)_y$ and $(EO)_{x'}$ are bonded to each other in block in this order; and (b) water, with the proportion of the compound represented by the formula (I) to the sum total of the compound and water being 5 wt. % or above but below 50 wt. %.

2. The composition as set forth in claim 1, wherein the proportion of the compound represented by the formula (1) to the sum total of the compound and water ranges from 15 to 40 wt. %.

3. The composition as set forth in claim 1, which further contains 0.1 to 10 wt. % of a water-compatible solvent.

4. A liquid detergent comprising the composition as a set forth in claim 1, which exhibits an excellent penetrating power for the object to be cleansed.

5. The liquid detergent as set forth in claim 4, which is useful for pre-washing of clothes.

* * * * *